US007275952B1

(12) United States Patent
Fabian

(10) Patent No.: US 7,275,952 B1
(45) Date of Patent: Oct. 2, 2007

(54) HINGED ELECTRICAL CONNECTOR

(75) Inventor: David James Fabian, Mount Joy, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/467,208

(22) Filed: Aug. 25, 2006

(51) Int. Cl.
*H01R 4/24* (2006.01)

(52) U.S. Cl. ..... 439/409

(58) Field of Classification Search ..... 439/409, 439/410, 358, 357, 948
See application file for complete search history.

(56) References Cited

U.S. PATENT DOCUMENTS 2,704,832 A * 3/1955 Greenbaum ..... 439/410
2,735,078 A * 2/1956 Greenbaum ..... 439/410
3,745,228 A * 7/1973 Vogt ..... 174/88 R
5,514,006 A * 5/1996 Getselis et al. ..... 439/417
7,137,845 B2 * 11/2006 Bernat et al. ..... 439/409

OTHER PUBLICATIONS

Modulight Innovative Fluorescent Lighting System, 2004, Juno Lighting, Inc., Des Plaines, IL, USA.

* cited by examiner

*Primary Examiner*—Phuong Dinh

(57) ABSTRACT

A hinged electrical connector is disclosed. The connector includes an arcuate lid portion and an arcuate connector housing portion hingedly attached to the lid portion. The lid portion includes a wire alignment structure to retain one or more wires in a compact fashion and the connector housing portion has at least one electrically conductive contact retained in it to engage the wires retained in the wire alignment structure. The lid and connector housing close to an operative position to form an electrical connector that can be passed through standard electrical panel knock-outs and which is also resistant to snagging.

21 Claims, 7 Drawing Sheets

5

HINGED ELECTRICAL CONNECTOR

FIELD OF THE INVENTION

The present invention is generally directed to connectors and more particularly to connectors to terminate electrical wiring.

BACKGROUND OF THE INVENTION

Electrical connectors are used to connect various forms of components and equipment. For example, some electrical connectors connect printed circuit boards to wires, which are used to convey power to appliances and utilities, such as lighting fixtures, ballasts and the like.

Overhead lighting, particularly the type used in warehouses and "big box" stores, presents a number of difficulties for those installing or maintaining the lights such as climbing to and working in rafters and other hard to reach places high above the floor, and often in low light conditions. Despite this, conventional connectors used in these applications generally have two or more separate pieces that must be assembled at the work site as part of terminating the wires during installation or maintenance. Thus, if a worker drops either piece of the connector while working on it, the worker may have to climb down, pick up the dropped piece, then climb back up to the work site, all of which increases the time, and thus the cost, of installation. In addition, falling and/or fallen pieces may create a hazard to those walking below.

Furthermore, the wires are often used in small spaces, with narrow, tortuous paths and tight tolerances. Conventional connectors used in overhead lighting applications are generally rectangular and have wide profiles and pointed edges. As a result, they have a tendency to become snagged, nor can they typically fit through standard size knock-outs in electrical paneling. Thus, terminated wires cannot simply be pulled from one or only a few locations and the installer must typically move about the rafters at or near each actual connection point. This problem may be aggravated because many conventional connectors also require the wires be crimped into the contact, adding an additional step to the process, which may require yet more tools.

These and other drawbacks are found in current connector systems.

What is needed is a connector that overcomes these and other drawbacks by reducing the number of separate pieces at the installation site and which can more easily be maneuvered through standard size conduits or knock-outs.

SUMMARY OF THE INVENTION

According to an exemplary embodiment of the invention, an electrical connector is disclosed. The connector comprises an arcuate lid portion having a wire alignment structure configured to receive a wire, an arcuate connector housing portion hingedly attached to the lid portion, and an electrically conductive contact retained in the connector housing portion and positioned to engage a wire received in the wire alignment structure. The lid and connector housing form a substantially cylindrical connector when the lid and connector housing are in an operative position.

According to another exemplary embodiment of the invention, a connector assembly for use with a wire comprises a plug member having a plug member mating face and a receptacle member having a receptacle member mating face. The receptacle member mating face has a geometry configured to engage the plug member mating face. The plug member comprises an arcuate lid portion having a wire alignment structure configured to receive a wire therein, an arcuate connector housing portion hingedly attached to the lid portion, and an electrically conductive contact retained in the connector housing, the contact positioned to engage a wire received in the wire alignment structure.

An advantage of some exemplary embodiments of the invention includes providing a pre-assembled, single piece connector, reducing the likelihood of lost or dropped pieces that must be retrieved before completing installation.

Another advantage of some exemplary embodiments of the invention includes providing a connector having a smaller profile than found in conventional connectors, allowing the connector to pass through standard size electrical paneling knockouts and permitting an installer to pull the connector, and the wire to which it is attached, to or from its installation point to its connection point with reduced risk of snagging.

Still another advantage of some exemplary embodiments of the invention includes providing one or more contacts in the connector that, when engaged with a varnish coated wire, displaces the varnish coating to expose a conductive surface of the wire to the contact, eliminating the need to strip the varnish in a separate operation.

Another advantage of some exemplary embodiments of the invention includes a wire stop that establishes a predetermined distance a wire travels into the connector to ensure proper contact between the wire and an electrical contact.

Yet another advantage of certain exemplary embodiments of the invention includes providing an electrical contact that captures an aligned wire within the connector to prevent movement that may cause interruptions in electrical communication.

Other features and advantages of the present invention will be apparent from the following more detailed description of exemplary embodiments, taken in conjunction with the accompanying drawings which illustrate, by way of example, the principles of the invention.

BRIEF DESCRIPTION OF THE DRAWINGS

Where like parts appear in more than one drawing, it has been attempted to use like reference numerals for clarity.

DETAILED DESCRIPTION OF EXEMPLARY EMBODIMENTS

Figure 1:
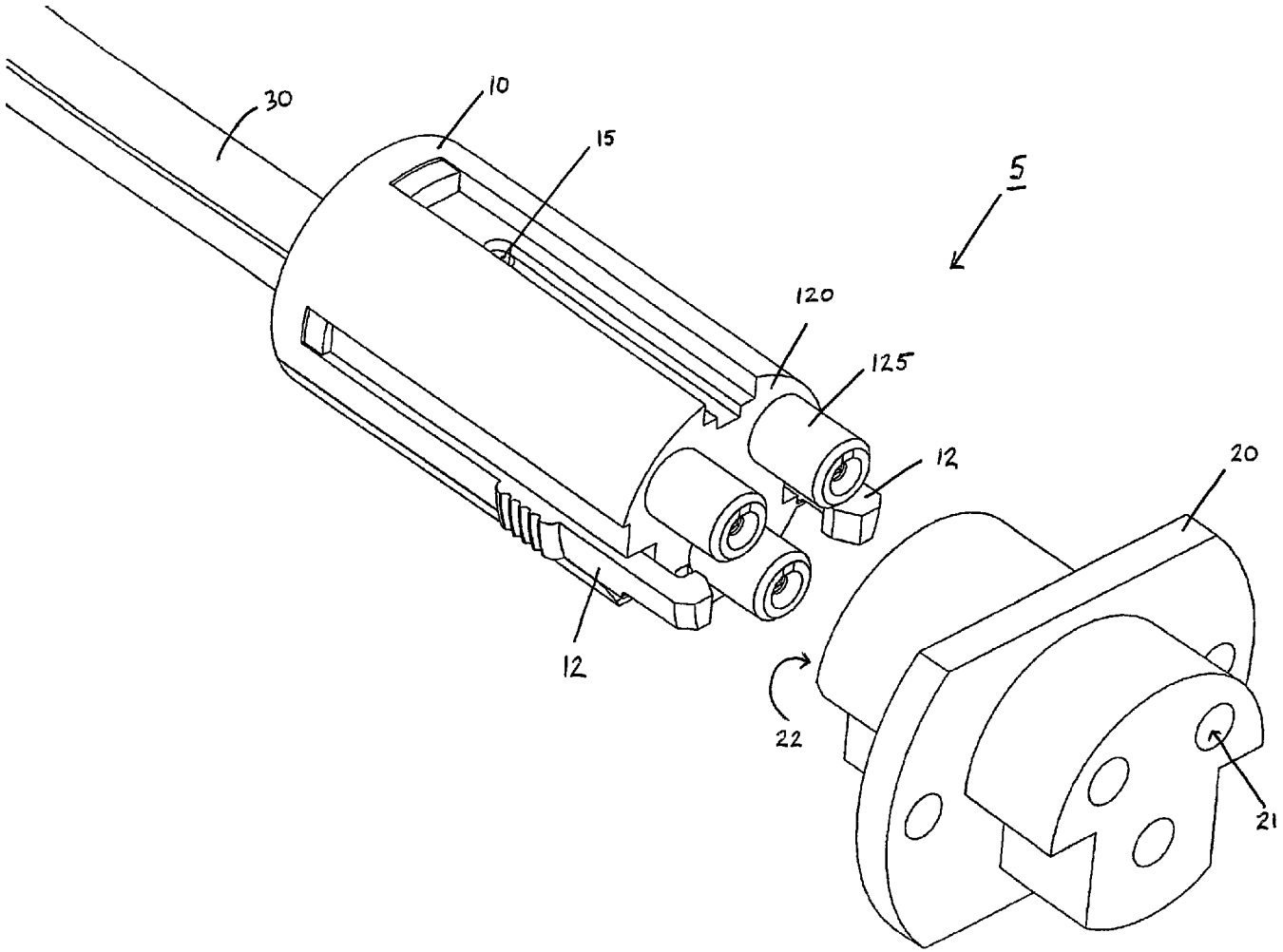
FIG. 1 is a perspective view of a connector assembly in accordance with an exemplary embodiment of the invention.
Figure 7:
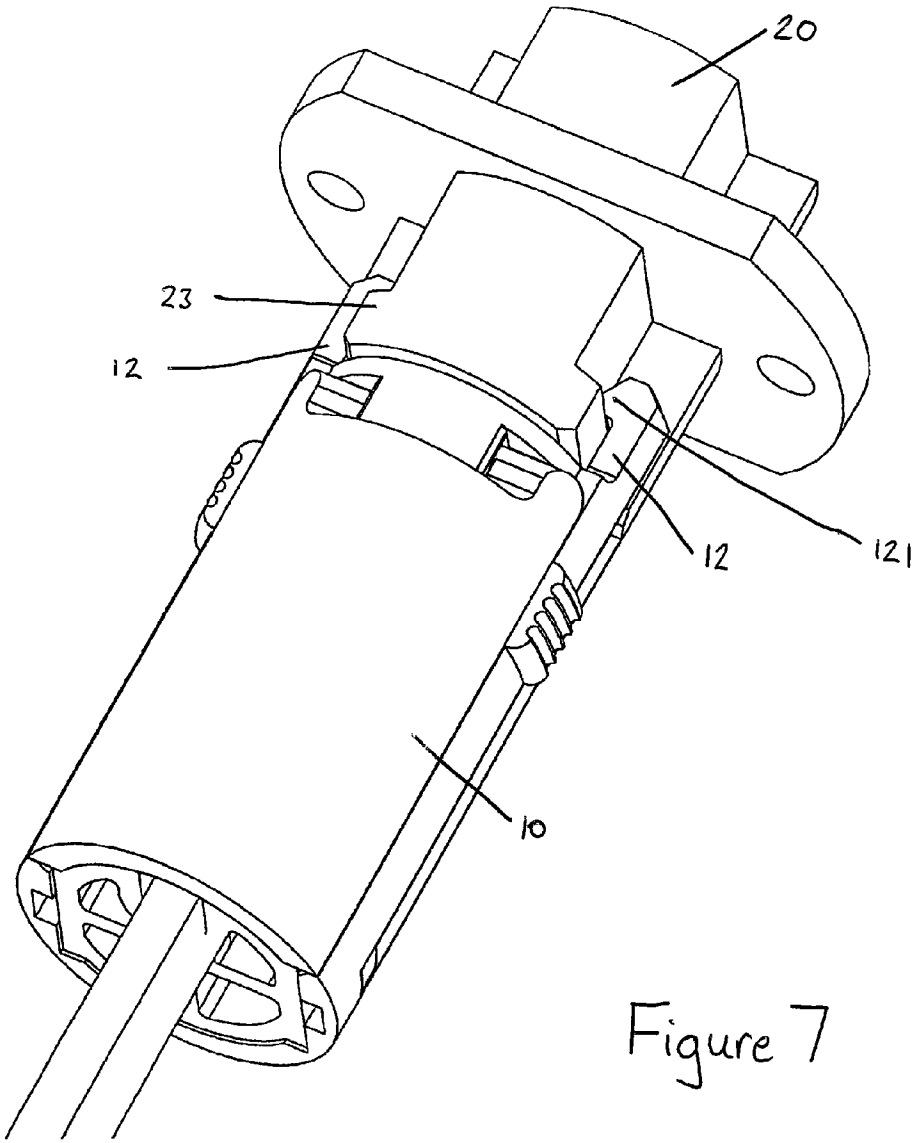
FIG. 7 is a perspective view of a connector assembly in a connected position.

FIG. 1 illustrates a connector assembly 5 comprising a first connector portion 10, also referred to herein as a plug member, and a corresponding second connector portion 20, or receptacle member. The plug member 10 and the receptacle member 20 are mate-ably connectable to one another (FIG. 7) to form a connector assembly 5 for use in wiring applications.

As illustrated in FIG. 1, the plug member 10 has a mating face 120 with three annular male elements 125 extending away from the mating face 120. The annular male elements 125 may be arranged to impart a geometric polarity that ensures the connector assembly 5 can be connected in only one way, thus ensuring individual wires are properly connected (e.g., ground to ground, positive to positive, negative to negative.).

Figure 2:
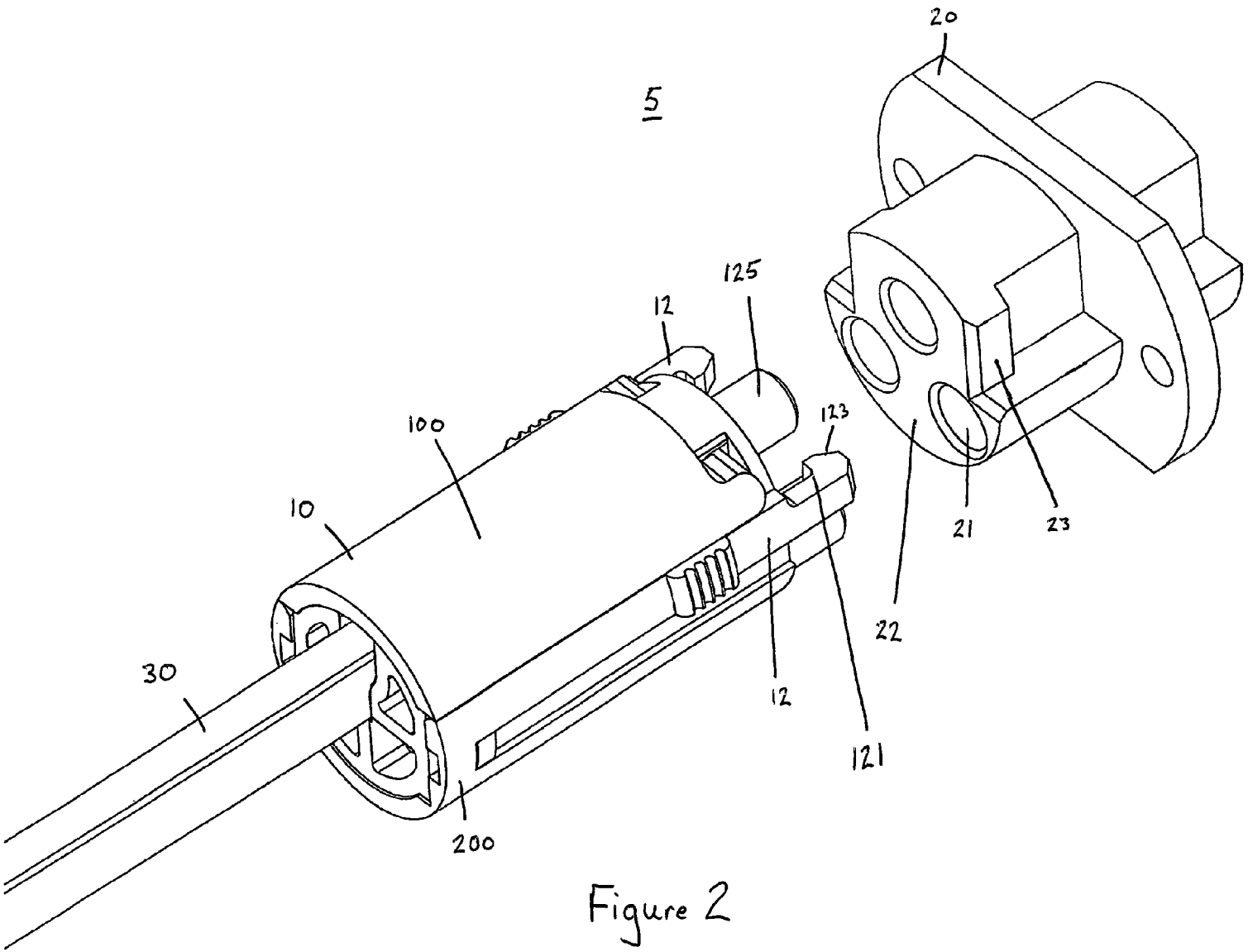
FIG. 2 illustrates an alternative view of the connector assembly shown in claim 1.

As better seen in FIG. 2, the receptacle member 20 has a corresponding mating face 22 with three female elements 21 in the form of channels extending through the receptacle member 20 that receive the plug member male elements 125. The receptacle member 20 typically has an electrically conductive pin (not shown) disposed in each female element 21 to mate with a pin receiver 410 of a contact 400 (FIG. 6) disposed in each plug member male element 125 to complete an electric circuit when the connector assembly 5 is fully connected. The receptacle member 20 has a geometry corresponding to the plug member 10.

A latch 12 extends from the plug member 10 to retain the connector assembly 5 in an assembled fashion. The latch 12 has a hook 121 to engage an off-set wall 23 in the receptacle member 20. When engaged, the connector assembly 5 remains connected even if the plug and receptacle members 10, 20 are pulled in opposite directions. Preferably, two latches 12 with slightly protruding press tabs 122 are provided. The latches 12 may be disposed on opposite sides of the plug member 10 so that the latches 12 can be released from the receptacle member 20 with a single hand, such as by squeezing one latch 12 with a thumb and the opposing latch 12 with the index finger. In another embodiment, one or more latches 12 may be integral with the receptacle member 20 and an off-set feature for capturing the latches 12 may be located on the plug member 10.

An angled leading edge 123 may be imparted to either or both of the latching members 12 and/or the receptacle member 20 such that the plug member 10 and the receptacle member 20 slide into an engaged position without needing to squeeze the latches 12 to connect the assembly 5. The plug and receptacle members 10, 20 remain in their connected position until an external squeezing force is applied to the press tabs 122 to release the plug and receptacle members 10, 20 from one another. The connecting of the assembly 5 by sliding thus results in an identifiable tactile feel and audible sound when the hooks 121 engage behind the off-set wall 23, indicating to a user that the assembly 5 was successfully connected. This may be advantageous to an installer performing assembly of the two connectors portions 10, in low light conditions and/or where the installer is unable to actually see the connectors portions 10, 20 while assembling them. Once engaged, a properly latched connector assembly 5 cannot be disengaged merely by pulling.

As illustrated and discussed herein, the plug member 10 is used to terminate wires from a wire bundle 30, such as wiring leading from overhead lighting, while the receptacle member 20 is typically a bulkhead connector attached to an electrical device, such as a circuit board or breaker. It will be appreciated however, that this arrangement is exemplary only. It will further be appreciated that while different aspects of the invention are discussed as having male or female configurations for achieving physical and/or electrical contact, the configurations could be reversed, or other types of configurations for mating two parts could be used instead.

The plug member 10 is substantially cylindrical and thus generally has a cross section without sharp edges, although it need not be exactly circular. As a result, the plug member 10 is less likely to become snagged in other wires than conventional rectangular overhead lighting connectors. The plug member 10 may be of any size and length, but is preferably sized to correspond to standard size knock-outs in electrical panels and conduits, such as those established by the National Electrical Manufacturers Association. According to one exemplary embodiment of the invention, the plug member is sized to correspond to standard knock outs of about 1 inch to about ⅞ inch in diameter. Thus, this generally corresponds to a plug member 10 that is about 1 inch or less in diameter and more preferably a plug member 10 about ⅞ inches or less in diameter. The size and geometry of exemplary embodiments of the present invention may facilitate terminating multiple separate wire bundles 30 with separate plug members 10 at a single location with the ability to subsequently pull both the wire bundles 30 and the plug members 10 to numerous different desired installation and/or connection points. Smaller or larger connectors 10 of similar configuration can be scaled up or down in size as required.

The plug member 10 has an arcuate lid 100 and an arcuate connector housing 200 that have been previously hingedly attached to one another at a hinge point 13 (FIG. 3), typically during manufacturing. As a result, an installer only needs a single piece in the form of the plug member 10 for each termination operation. The installer simply pivots away the portion of the connector not being worked with, without the risk that it will fall to the floor and need to be retrieved. The lid and the connector housing may be constructed of any insulating material, and typically are injection molded using a non-conductive thermoplastic.

Figure 3:
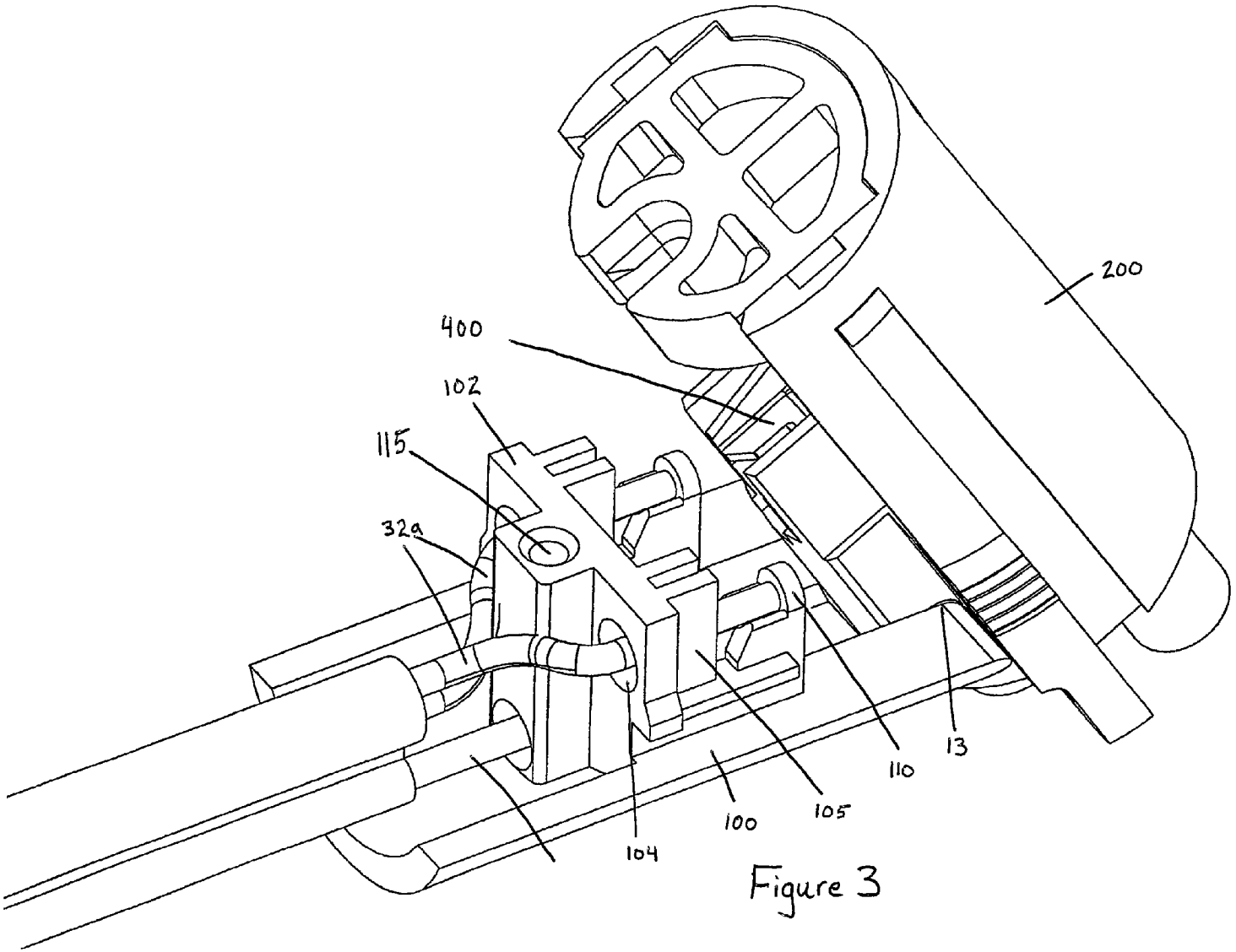
FIG. 3 illustrates a connector portion according to an exemplary embodiment of the invention.

Turning to FIG. 3, the lid 100 serves as a wire retainer portion of the plug member 10. While an installer works to strip and insert wires 32 from the wire bundle 30 into the lid 100, the connector housing 200 can simply be pivoted out of the way, providing room to work. As illustrated, the wire bundle 30 comprises two wires 32*a* in a common plastic insulating sheath and a separately sheathed ground wire 32*b*, or a total of three wires 32 that are terminated in the connector 10. It will be appreciated that fewer or more wires may be used. However, one aspect of certain exemplary embodiments of the invention is the ability to terminate three or more wires in a compact fashion in a single piece connector that is still small enough in diameter to fit through standard size electrical panel knock-outs.

To retain the wires 32 close together in a compact manner, while still separating them far enough apart to engage separate contacts 400 within the connector 10, the lid 100 includes a wire alignment structure 102. As shown in FIG. 3, the wire alignment structure includes a wall extending away from the lid 100 toward the connector housing 200. The wire alignment structure 102 includes one or more apertures that form separate collars 104 for each wire 32 in the wire bundle 30. The collars 104 align the wires 32 so that the contacts 400 in the connector housing 200 will individually engage a corresponding wire 32 when the lid 100 is closed to an operative position.

As also shown in FIG. 3, the lid 100 may include one or more pairs of cantilevered walls 105 extending inwardly away from the wire alignment structure 102 in the direction of wire insertion. Each cantilevered wall pair 105 is associated with a different wire collar 104; each wall in the pair is disposed on diametrically opposite sides of the collar 104. Thus, each cantilevered wall pair 105 provides an interference fit with an inserted wire 32 passing through the wall pair's associated collar 104. This may assist in keeping the wire aligned and in place until the lid 100 is closed and the connector 10 is fully operative.

The lid 100 may also include one or more wire stops 110 that define a maximum distance of inward travel for the inserted wire(s) 32. The wire stop 110 thus prevents a wire 32 from being inserted too far into the connector 10, which may interfere with the ability to close the lid 100, for example. In addition to preventing the wire 32 from being inserted too far, the wire stop 110 also serves as a tactile guide to a user that the wire 32 has been inserted far enough, i.e. a sufficient distance to ensure that the contact 400 will engage the wire 32 when the lid 100 is closed.

Figure 4:
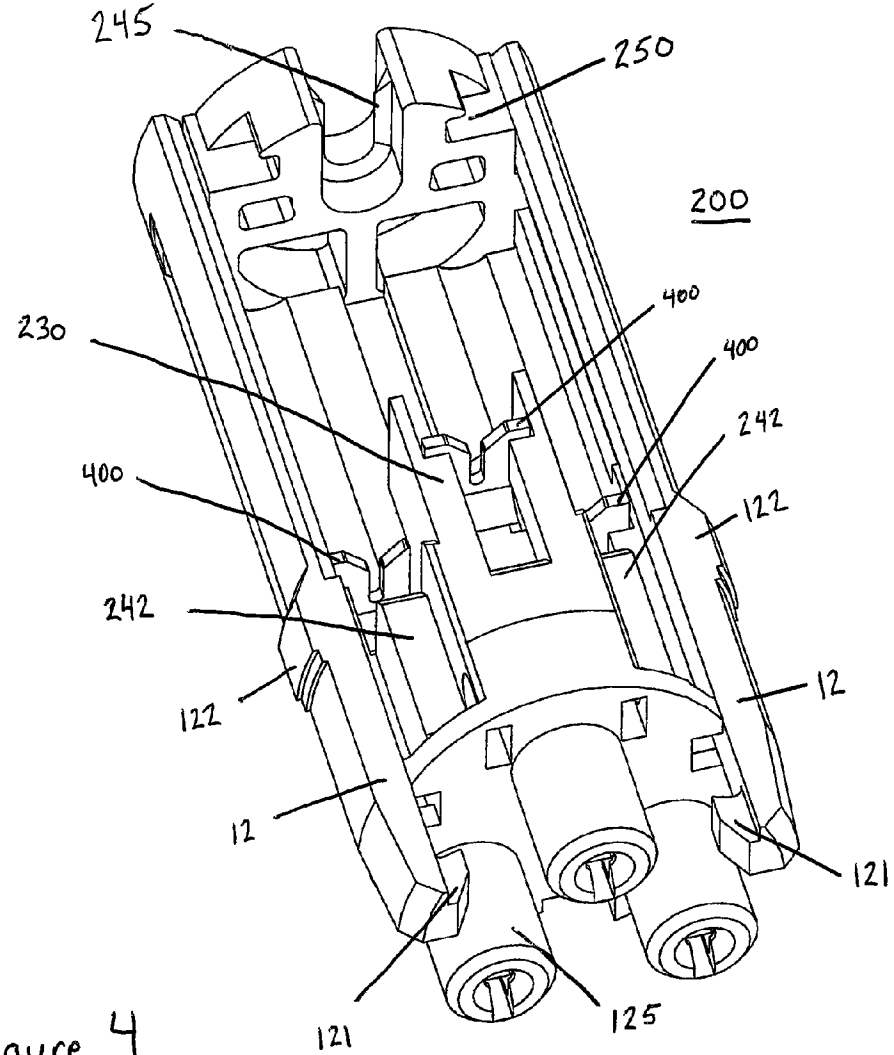
FIG. 4 illustrates the connector housing portion of the connector shown in FIG. 3.
Figure 5:
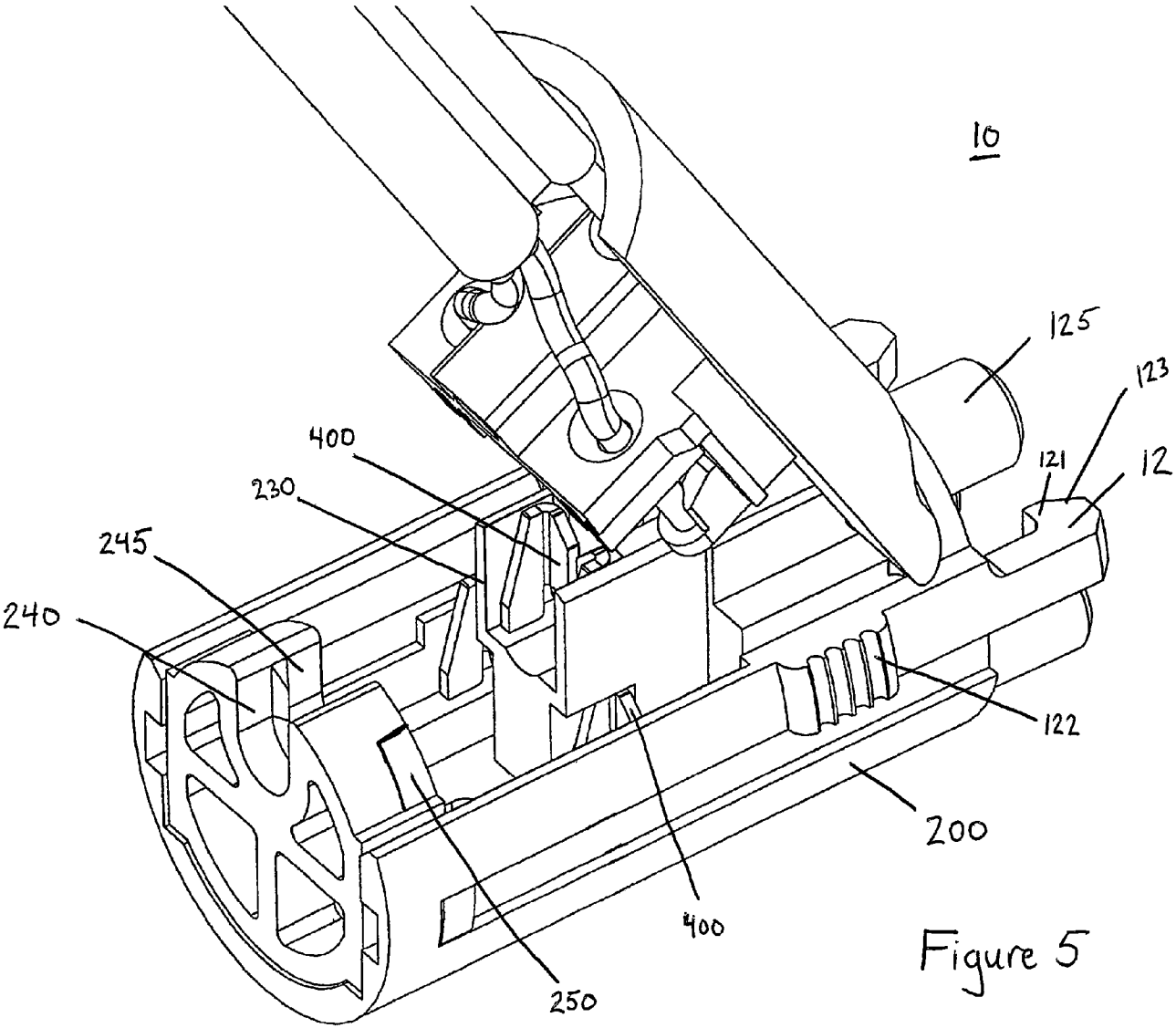
FIG. 5 illustrates an alternative view of the connector shown in FIG. 3.

Turning to FIGS. 4 and 5, the connector housing 200 has an electrically conductive contact 400, and preferably a plurality of conductive contacts 400, positioned to engage the wires 32 retained in the lid 100. For clarity, FIG. 4 shows only the connector housing 200 without the lid 100. The connector housing 200 has a contact alignment structure 230 configured to align and retain the contacts 400, such that one end of each contact 400 extends into a respective plug member male element 125.

Figure 6:
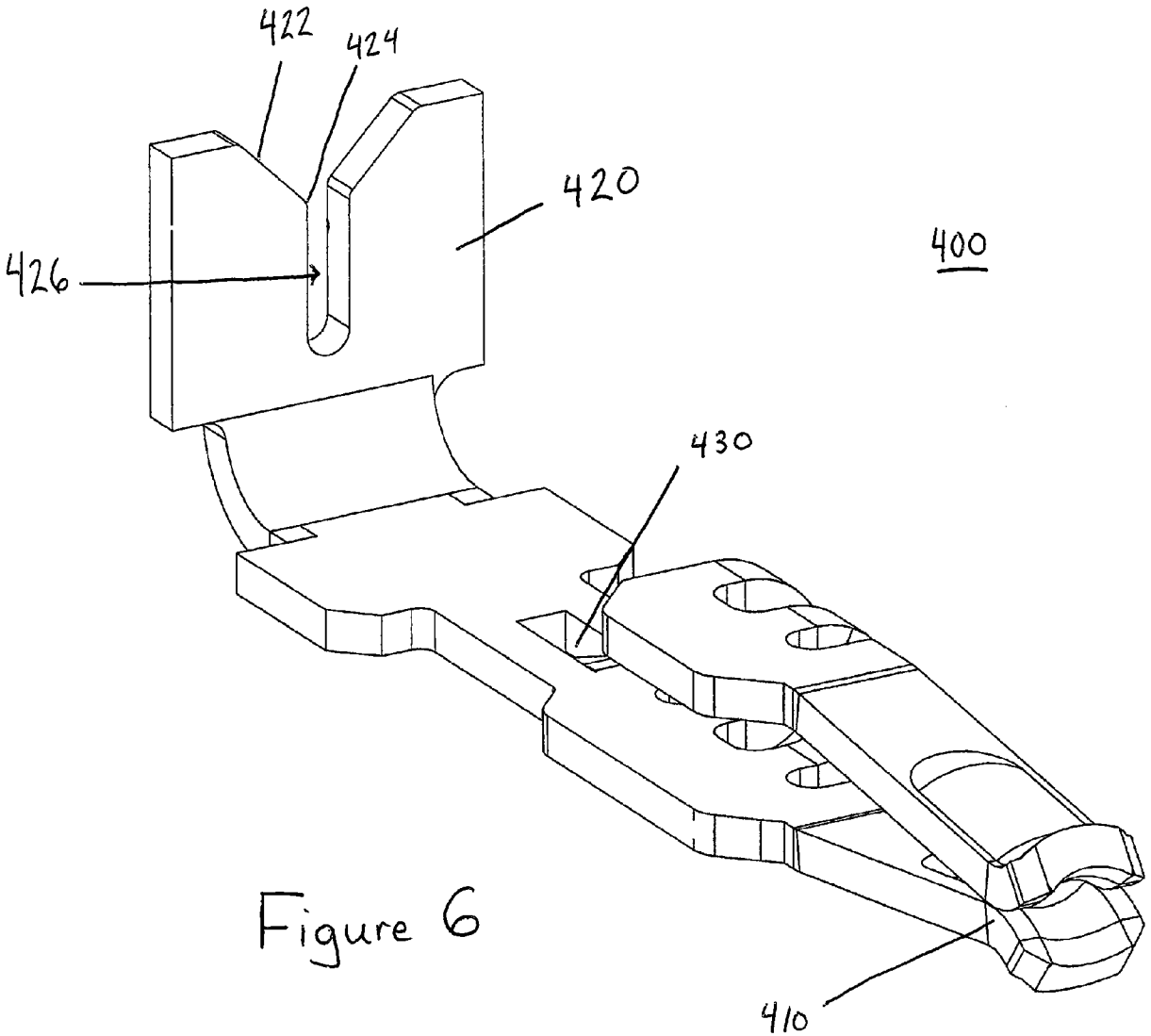
FIG. 6 illustrates a contact for use in a connector according to an exemplary embodiment of the invention.

FIG. 6 illustrates the contact 400 in greater detail, which is preferably a stamped and formed unitary piece of any conductive material, typically copper or an alloy thereof. A pin receiver 410 is located at one end of the contact 400 for insertion into the male element 125 of the connector housing 200 as described above and to receive the pin from the receptacle member 20 to complete an electrical circuit when the plug and receptacle are mated. Although the contact 400 need only touch the wire 32, the contact 400 preferably includes a contact head 420 having a wire channel 426 at the end opposite the pin receiver 410. The wire channel 426 captures the wire 32 when the lid 100 is closed to firmly retain the wire, decreasing and preferably eliminating relative movement between the wire 32 and contact 400 which may lead to interruptions or inconsistencies in electrical communication. To capture the wire, the wire channel 426 is dimensioned slightly narrower than the diameter of the wire 32. The wire 32 is forced into the channel 426 by closing the lid 100 to its operative position and the wire is retained there by an interference fit. Thus, the need to individually crimp wires into their respective contacts is eliminated.

In some cases, one or more of the wires 32 may have an insulating varnish coating, typically about 5 to 10 mils thick, in addition to, or in lieu of, the insulating plastic sheath surrounding the wire bundle 30. Thus, even after the plastic insulation has been stripped, any varnish coated wires must also still be stripped of varnish to expose an electrically conductive surface of the wire 32 to the contact 400. In some cases, wires with or without varnish may also have an undesirable oxide build-up that must also be removed.

Varnish and oxide coatings typically adhere strongly to the wire and often requires a separate, more time consuming stripping step that is eliminated according to some exemplary embodiments of the invention in which the contact 400 is a coating self-stripping contact 400. In this embodiment, the wire channel 426 is dimensioned large enough to engage an uncoated wire, but not wide enough to receive a varnish or oxide coated wire, which coating is displaced as the wire 32 is forced into the wire channel 426.

To assist in the self-stripping operation, the contact head 420 may include a sloped wire guide 422 leading to a coating displacement element 424 at the interface of the wire guide 422 and the wire channel 426. The coating displacement element 424 may have a sharp edge. Like the wire channel 426, the coating displacement element 424 is dimensioned such that when a varnish coated wire 32 passes from the wire guide 422 into the wire channel 426, at least a portion of the varnish coating is displaced, exposing a conductive surface of the wire 32 to the contact head 420. It will be appreciated that wires of different gauge may be used within the wire bundle 30; for example, the ground wire **32*b* may be of a smaller gauge than the hot and common wires 32*a*. Thus, the dimensions of the wire channel 426** needed to achieve the desired self-stripping result may depend on both the wire gauge used and the thickness of the varnish.

The contact 400 may also incorporate a one-way tab 430 to engage a corresponding retainer (not shown) in the connector housing 200 to permit easy insertion of the contact 400 during manufacturing, but prevent the contact 400 from subsequently falling out or being removed in the field without the use of a special tool. Alternatively, or in combination, other methods of permanently or semi-permanently retaining the contact 400 in the connector housing 200, such as an adhesive, may also be used.

Returning to FIGS. 4 and 5, the connector housing 200 is further shown having two integral latches 12 for removably connecting the plug member 10 with the receptacle member 20 to form the connector assembly 5. Each latch 12 generally extends the entire length of the connector housing 200. When the press tabs 122 are depressed inward toward a tab stop 242 in the connector housing 200, the hooks 121 expand outward at least far enough to permit the latches 12 to disengage from the receptacle member 20. By providing latches 12 that extend along the length of the entire connector housing 200, comparatively less inward travel is needed to cause sufficient outward expansion of the hooks 121 to release the connector assembly 5 in the desired manner.

As described previously, the hooks 121 may include an angled leading edge 123, so that pushing the plug member 10 toward the receptacle member 20 forces the hooks 121 to expand outward without squeezing the press tabs 122 to make the connection. The press tabs 122 are typically the widest point of the connector 10 but are low profile and do not prevent the connector 10 from being pulled through a standard electrical paneling knockout. By "low profile" is meant that the press tabs 122 contribute to the compact nature of exemplary embodiments of the invention in that the press tabs 122 can be squeezed flush with the connector housing 200. As a result, both the wire bundle 30 and the connector 10 can be pulled through paneling during installation.

After all the wires 32 have been inserted into the lid 100, the lid 100 can be pivoted closed and locked in its operative position with the connector housing 200. In order to force all the wires 32 into the wire channels 426 of their respective contacts 400, and thus ensure full electrical communication between them, it may be desirable to use a tool, such as a wrench or pliers to fully close the lid 100. The connector housing 200 may further include a bundle retainer 245 that provides an interference fit to retain the wire bundle 30 in the connector 10. Any suitable method of locking the lid 100 with the connector housing 200 may be used. For example, the lid 100 may be locked in its closed position using a dovetail (not shown) that engages a dovetail slot 250 in the connector housing 200. Alternatively, or in combination with the dovetail lock, the lid 100 and connector housing 200 may include apertures 15, 115 (FIGS. 1 and 3) that are in substantial registration with one another when the lid 100 is closed. A screw or other anchoring device may be inserted through the apertures to keep the lid 100 and connector housing 200 securely closed.

While the foregoing specification illustrates and describes exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical connector for use with a wire comprising
an arcuate lid portion having a wire alignment structure configured to receive a wire;
an arcuate connector housing portion hingedly attached to the lid portion; and
an electrically conductive contact retained in the connector housing portion and positioned to engage a wire received in the wire alignment structure,
wherein the wire alignment structure comprises a wall extending away from the lid portion toward the connector housing portion and an aperture extending therethrough, the aperture configured to individually receive and position a single wire with respect to a corresponding contact in the contact housing portion and to temporarily retain the wire in the connector, and
wherein the lid and connector housing form a substantially cylindrical connector when the lid and connector housing are in an operative position.

2. The electrical connector of claim 1, further comprising at least one latch member extending from the connector housing portion and configured to connect the connector with a corresponding second connector.

3. The electrical connector of claim 1, wherein the connector has a diameter of less than about 1 inch when the lid and connector housing are in an operative position.

4. The electrical connector of claim 1, wherein the connector has a diameter of less than about ⅞ inch when the lid and connector housing are in an operative position.

5. The electrical connecter of claim 1, wherein the wire alignment structure further comprises a pair of cantilevered walls associated with the aperture, wherein the walls are disposed on diametrically opposite sides of the aperture.

6. The electrical connector of claim 1, wherein the lid portion further comprises a wire stop that defines a distance of maximum inward travel of a received wire.

7. The electrical connector of claim 1, wherein the wire alignment structure is configured to receive and position at least three wires and wherein the connector housing portion contains at least three contacts, each contact positioned to separately engage a single corresponding wire.

8. The electrical connector of claim 1, wherein the contact comprises a contact head and a pin receiver, wherein the contact head includes a wire channel portion configured to engage and capture a corresponding wire.

9. The electrical connector of claim 1, wherein the contact comprises a contact head and a pin receiver, wherein the contact head includes a wire guide portion and a wire channel portion and wherein an interface of the wire guide portion and the wire channel portion defines a coating displacement element dimensioned to displace a coating from a coated wire passing from the wire guide portion to the wire channel portion, thereby exposing a conductive surface of the wire to the contact.

10. The electrical connector of claim 1, wherein the connector is an overhead lighting connector.

11. The electrical connector of claim 1, wherein the contact is a unitary piece of electrically conductive material.

12. A connector assembly for use with a wire comprising
a plug member having a plug member mating face, the plug member comprising
an arcuate lid portion having a wire alignment structure comprising a wall extending away from the lid portion having an aperture therethrough configured to receive and temporarily retain a wire therein,
an arcuate connector housing portion hingedly attached to the lid portion, and
an electrically conductive contact retained in the connector housing, the contact positioned to engage a wire received in the wire alignment structure; and
a receptacle member having a receptacle member mating face, wherein the receptacle member mating face has a geometry configured to engage the plug member mating face.

13. The connector assembly of claim 12, wherein the plug member is substantially cylindrical when the lid and connector housing are in an operative position.

14. The connector assembly of claim 12, wherein the plug member further comprises at least one latch member integral with and extending the length of the connector housing portion, the latch member positioned to retain the connector assembly in a connected position when the plug member mating face is engaged with the receptacle member mating face.

15. The connector assembly of claim 12, wherein the connector assembly is an overhead lighting connector assembly.

16. The connector assembly of claim 15, wherein the plug member is dimensioned to fit through a ⅞ inch electrical panel knock out.

17. A method for terminating a wire comprising
providing at least two wires;
providing a connector comprising
an arcuate lid portion having a wire alignment structure comprising a wall extending away from the lid portion having at least two apertures therethrough configured to receive at least two wires therein, each wire aperture configured to individually receive position and temporarily retain a single wire,
an arcuate connector housing portion hingedly attached to the lid portion, and
at least two electrically conductive contacts retained in the connector housing portion;
exposing a conductive surface on each wire;
separately inserting each wire into the wire alignment structure; and
contacting each wire in the wire alignment structure of the lid portion with a corresponding contact in the connector housing portion.

18. The method of claim 17, wherein the step of exposing a conductive surface on each wire comprises
stripping plastic sheathing from the wire; and
forcing the wire to pass through a coating displacement element into a wire channel in the contact.

19. The method of claim 17, wherein the step of contacting comprises closing the lid portion of the connector toward the connector housing portion of the connector.

20. An electrical connector for use with a wire comprising an arcuate lid portion having a wire alignment structure configured to receive a wire;

an arcuate connector housing portion hingedly attached to the lid portion; and an electrically conductive contact retained in the connector housing portion and positioned to engage a wire received in the wire alignment structure, wherein the lid and connector housing form a substantially cylindrical connector when the lid and connector housing are in an operative position and wherein the wire alignment structure comprises an aperture extending through the wire alignment structure and a pair of cantilevered walls associated with the aperture and disposed on diametrically opposite sides of the aperture, the aperture configured to individually receive and position a single wire with respect to a corresponding contact.

21. An electrical connector for use with a wire comprising an arcuate lid portion having a wire alignment structure configured to receive a wire;

an arcuate connector housing portion hingedly attached to the lid portion; and an electrically conductive contact comprising a contact head and a pin receiver retained in the connector housing portion and positioned to engage a wire received in the wire alignment structure, wherein the lid and connector housing form a substantially cylindrical connector when the lid and connector housing are in an operative position and wherein the contact head includes a wire guide portion and a wire channel portion and wherein an interface of the wire guide portion and the wire channel portion defines a coating displacement element dimensioned to displace a coating from a coated wire passing from the wire guide portion to the wire channel portion, thereby exposing a conductive surface of the wire to the contact.

* * * * *